US005294956A

United States Patent [19]

Earle

[11] Patent Number: 5,294,956

[45] Date of Patent: Mar. 15, 1994

[54] PHOTOGRAPHIC PROCESSING APPARATUS

[75] Inventor: Anthony Earle, Middlesex, United Kingdom

[73] Assignee: Eastman Kodak Company, Rochester, N.Y.

[21] Appl. No.: 949,848

[22] PCT Filed: Mar. 23, 1992

[86] PCT No.: PCT/EP92/00631

§ 371 Date: Nov. 20, 1992

§ 102(e) Date: Nov. 20, 1992

[87] PCT Pub. No.: WO92/17818

PCT Pub. Date: Oct. 15, 1992

[30] Foreign Application Priority Data

Mar. 26, 1991 [GB] United Kingdom ..... 9106439

[51] Int. Cl.[5] ..... G03D 3/02

[52] U.S. Cl. ..... 354/324; 354/331; 354/336

[58] Field of Search ..... 354/318-324, 354/328, 331, 336; 134/64 P, 8, 64 R, 122 P, 122 R

[56] References Cited

U.S. PATENT DOCUMENTS

| | | | |
|---|---|---|---|
| 4,112,453 | 9/1978 | Hutchison | 354/322 |
| 4,368,010 | 1/1983 | Kohlbauer et al. | 417/271 |
| 4,888,608 | 12/1989 | Kummerl | 354/324 |
| 4,922,276 | 5/1990 | Lamprecht et al. | 354/299 |

FOREIGN PATENT DOCUMENTS 2068782A 8/1981 United Kingdom .

*Primary Examiner*—D. Rutledge

*Attorney, Agent, or Firm*—Nixon, Hargrave, Devans & Doyle

[57] ABSTRACT

In known photographic processing apparatus, pumps are used to recirculate and re cycle processing solutions thereby producing the desired agitation of the processing solutions. However, such pumps are normally mounted externally to the processing tank and are connected thereto by means of an arrangement of flexible pipes. Described herein Is a modular processing tank arrangement in which the pumps are mounted integrally with the module. This means that the module can be removed as a whole without having to disconnect a large number of pipes.

6 Claims, 1 Drawing Sheet

PHOTOGRAPHIC PROCESSING APPARATUS

BACKGROUND OF THE INVENTION

This invention relates to photographic processing apparatus and is more particularly concerned with processing racks for use in such apparatus.

Published international patent application WO91/19226 (based on British patent application 9012860.4) discloses photographic processing apparatus in which a series of low volume processing tanks are provided. Each tank comprises a complete module or rack which can be removed from the apparatus for repair or maintenance. This arrangement enables the apparatus down-time to be minimized as the module or rack under repair is simply replaced with an identical operational module or rack.

In such apparatus, problems associated with non-uniform processing of the photographic material may be encountered due to local differences in the concentration of the processing solution. Agitation of the processing solution appears to provide one solution to this problem.

In other known photographic processing apparatus, pumps are used to recirculate and recycle processing solutions thereby producing the desired agitation of the processing solutions. However, such pumps are normally mounted externally to the processing tank and are connected thereto by means of an arrangement of flexible pipes. Submersible pumps mounted at the bottom of the processing tank and impellors may also be used to provide the necessary agitation.

SUMMARY OF THE INVENTION

It is therefore an object of the present invention to provide a module or rack arrangement in which agitation pumps form an integral part of the module or rack.

According to one aspect of the present invention, there is provided photographic processing apparatus for processing photographic material comprising:

at least one processing tank;

a water bath surrounding the processing tank;

guide rollers for guiding material to be processed into and out of the processing tank; and transport means for transporting the photographic material through the apparatus;

characterized in that the processing tank comprises a self-contained rack;

and in that at least one pump is mounted so as to be integral with the rack.

Advantageously, there may be a plurality of separate pumps mounted integrally with the rack, each pump performing out a different function. Each pump may form part of a pump unit which is removable from the rack.

By this arrangement, the necessity for flexible pipe connections as discussed above is removed, making each processing stage modular and allowing rapid updates of the apparatus to be made as necessary.

For a better understanding of the present invention, reference will now be made, by way of example only, to the accompanying drawing, the single figure of which illustrates a schematic cross-section through a processing module or rack constructed in accordance with the present invention.

DETAILED DESCRIPTION OF THE INVENTION

Figure 1:
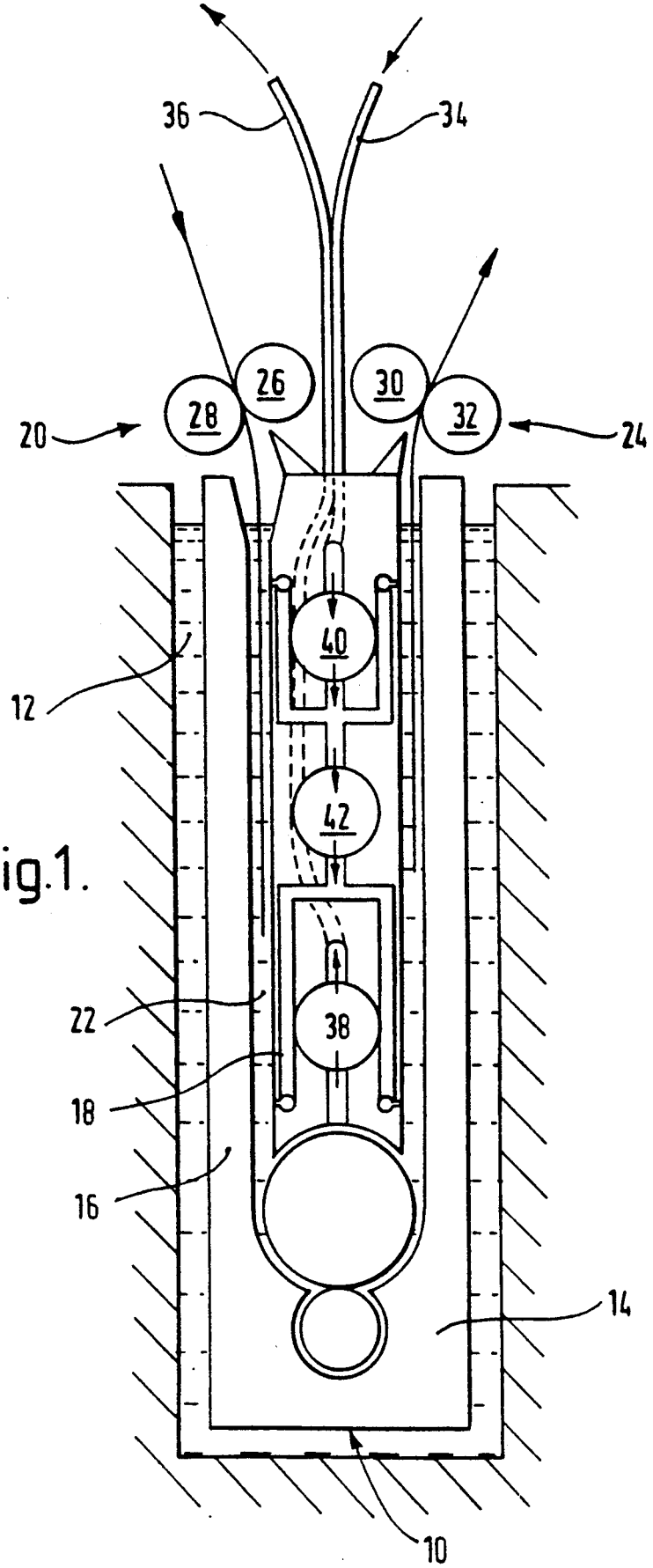
FIG. 1 is a module of low volume processing vessel showing a pump integral with the module.

In FIG. 1, a low volume processing module or rack 10 is mounted in a water bath 12. The rack 10 comprises two outside wall members 14, 16 and a central section 18. Photographic material to be processed, for example photographic paper, enters the rack 10 at 20, passes through processing solution 22 retained between the outside wall members 14, 16 and the central section 18, and out of the rack 10 at 24. Guide roller pairs 26, 28 and 30, 32 are positioned at 20 and 24 respectively as shown. Processing solution 22 is added to and removed from the rack 10 via pipes 34 and 36 respectively.

In accordance with the present invention, pumps 38, 40, 42 are incorporated into the rack 10. The pumps 38, 40, 42 are mounted in the central section 18 as shown. In this particular arrangement, three pumps are used: a drain pump 38, a replenishment pump 40 and a circulation pump 42. It is to be understood that a greater or lesser number of pumps could be used depending on the particular arrangement of the rack 10.

The drain pump 38 empties processing solution 22 out of the rack 10 via pipe 36, and the replenishment pump 40 adds solution 22 via pipe 34. The circulation pump 42 provides agitation and mixing of the processing solution to ensure uniform processing of the material.

Although, only one rack 10 is illustrated, a minilab processor would have a series of these racks, one for each stage of the process.

By making the pumps integral with the rack 10, the following advantages are obtained:

1) A self-contained unit is obtained which does not require the mounting of external pumps and external pipe connections to be made.

2) Each rack 10 can be provided as a complete retrofit for existing processing apparatus.

3) If leaks occur from the rack 10, they are contained in the water tank 12 and stray solutions do not contaminate other rack arrangement or pass easily to drain.

4) The volume of processing solutions used is kept to a minimum—and this is especially suitable for apparatus using unstable processing solutions.

5) The delivery of processing solutions is controlled and the arrangement does not allow unauthorised tampering with the delivery—this is vital when selective component replenishment is being used.

It may be desirable to have the pumps arranged so that they can be removed as a single pump unit from the rack, and the pumps may be low voltage pumps.

The pumps may be driven directly from the transport mechanism for transporting the material through the apparatus. In this case, there is no need for separate motors to operate the pumps.

Although the example shown is specific to a low volume tank handling unstable chemistry, the principle could be applied to any existing conventional photographic processor or any similar process that uses tanks for treatment.

I claim:

1. Photographic processing apparatus for processing photographic material comprising:

at least one processing tank, a water bath surrounding the processing tank, guide rollers for guiding material to be processed into and out of the processing tank, and transport means for transporting the photographic material through the apparatus;

characterized in that the processing tank comprises a self-contained rack;

and in that at least one pump is mounted so as to be integral with the rack.

2. Apparatus according to claim 1, wherein there are a plurality of separate pumps mounted integrally with the rack, each pump performing out a different function.

3. Apparatus according to claim 1, wherein each pump forms part of a pump unit which is removable from the rack.

4. Apparatus according to claim 1, wherein each pump is a low voltage pump.

5. Apparatus according to claim 1, wherein each pump is driven by the transport means.

6. Apparatus according to claim 1, wherein each processing tank is of low volume.

* * * * *